US008783282B2

(12) United States Patent
McKeague

(10) Patent No.: US 8,783,282 B2
(45) Date of Patent: Jul. 22, 2014

(54) RECONFIGURABLE WATER FLUSHING AND SAMPLING DEVICE

(75) Inventor: Daniel G. McKeague, Kirkwood, MO (US)

(73) Assignee: John C. Kupferle Foundry Company, St. Louis, MO (US)

( * ) Notice: Subject to any disclaimer, the term of this patent is extended or adjusted under 35 U.S.C. 154(b) by 220 days.

(21) Appl. No.: 13/500,278

(22) PCT Filed: Oct. 15, 2010

(86) PCT No.: PCT/US2010/052822

§ 371 (c)(1),
(2), (4) Date: Apr. 4, 2012

(87) PCT Pub. No.: WO2011/047246

PCT Pub. Date: Apr. 21, 2011

(65) Prior Publication Data

US 2012/0192961 A1 Aug. 2, 2012

Related U.S. Application Data

(60) Provisional application No. 61/391,640, filed on Oct. 10, 2010, provisional application No. 61/252,031, filed on Oct. 15, 2009.

(51) Int. Cl.

| | |
|---|---|
| ***E03B 9/02*** | (2006.01) |
| ***E03B 7/09*** | (2006.01) |
| ***E03B 7/07*** | (2006.01) |

(52) U.S. Cl.

CPC . *E03N 7/08* (2013.01); *E03B 7/095* (2013.01); *E03B 7/078* (2013.01)

USPC ..... 137/294; 137/301; 134/104.1; 134/166 C

(58) Field of Classification Search

CPC ..... E03B 9/14; E03B 9/18; F16K 27/006

USPC ..... 137/15.04, 15.05, 237, 238, 294, 301; 134/104.1, 166 R–166 C

See application file for complete search history.

(56) References Cited

U.S. PATENT DOCUMENTS

| | | | | |
|---|---|---|---|---|
| 5,099,565 | A | 3/1992 | Campbell | |
| 6,216,792 | B1 * | 4/2001 | Miller | 169/46 |
| 6,820,635 | B1 | 11/2004 | McKeague | |
| 7,473,359 | B1 * | 1/2009 | Barrett, II | 210/232 |
| 2004/0252556 | A1 * | 12/2004 | Taylor et al. | 365/189.05 |
| 2007/0075162 | A1 | 4/2007 | McKeague | |

* cited by examiner

*Primary Examiner* — John K Fristoe, Jr.
*Assistant Examiner* — Reinaldo Sanchez-Medina
(74) *Attorney, Agent, or Firm* — Polster, Lieder, Woodruff & Lucchesi, L.C.

(57) ABSTRACT

A reconfigurable water flushing and sampling device which permits the same device to be utilized as a manual flusher, a continuous flushing device, an automatic flushing device, or a sampling station, or combinations thereof.

3 Claims, 9 Drawing Sheets

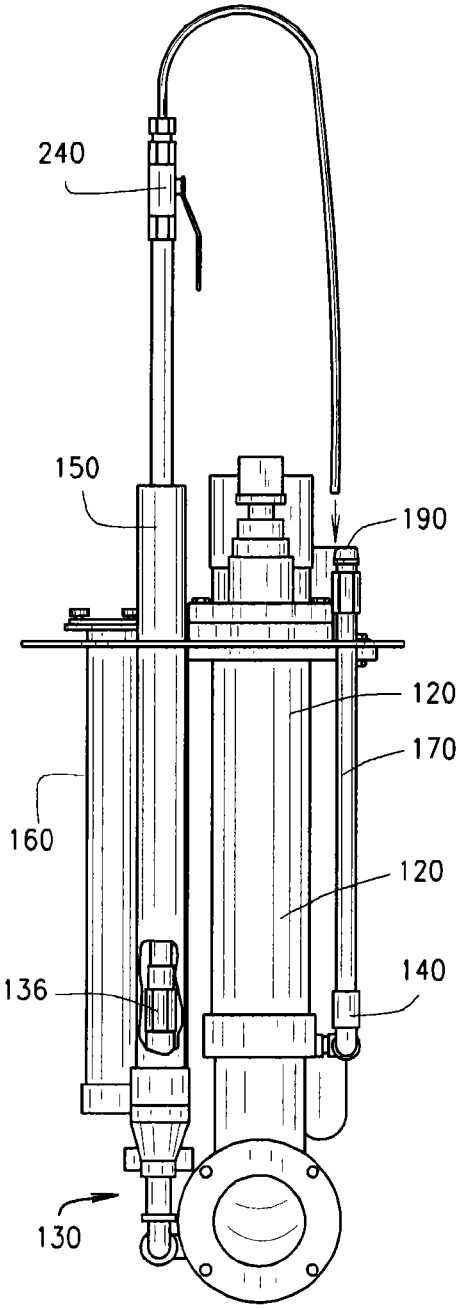
FIG. 11
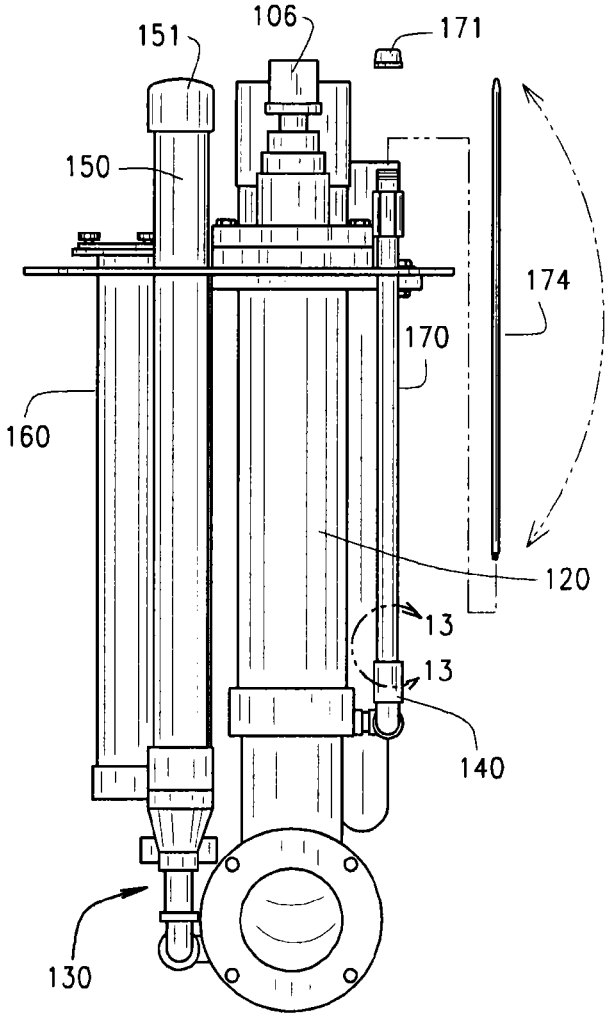
FIG. 12
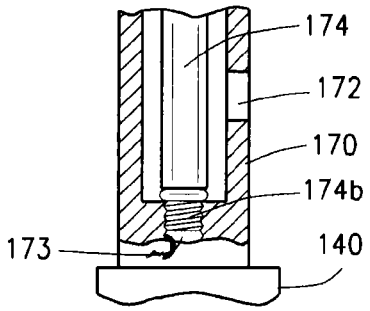
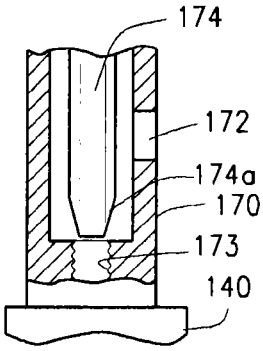
FIG. 14
FIG. 13

RECONFIGURABLE WATER FLUSHING AND SAMPLING DEVICE

CROSS-REFERENCE TO RELATED APPLICATIONS

This application is a national phase application under 35 U.S.C. §371 of Patent Cooperation Treaty application PCT/US2010/052822, filed Oct. 15, 2010, which claims the benefit of Provisional U.S. applications 61/252031, filed Oct. 15, 2009, and 61/391640, filed Oct. 10, 2010, both of which are incorporated by reference herein.

STATEMENT REGARDING FEDERALLY SPONSORED RESEARCH

Not applicable.

BACKGROUND OF THE INVENTION

Dead-ends on water systems are a constant source of water quality problems. The water is not flowing and therefore becomes stagnant, and flushing is required. This is time consuming and inconsistent.

Also, new EPA regulations are calling for a minimum amount of chlorine to be present at all times at dead-ends. This requires flushing. Other new regulations are requiring that all water systems monitor and control the presence of "disinfectant by-products" (DBPs) within their water. These DBPs are potentially cancer-causing remnants of the chlorination process Also, samples need to be taken within all water systems to meet EPA regulations. Many flushing systems have been invented over the years. Simple systems merely utilize a standpipe and a buried valve near the standpipe; workers periodically open the valve and flush the segment of the water system near the standpipe. Others use automatic systems which flush periodically or which flush based on sensed water quality. Still others flush continuously at a low rate. Some flushing systems flush to the ground, while others discharge into a sewer. Some water systems require periodic testing of the water while others do not. Installing a flushing system initially is time-consuming and expensive. The problem, however, is that the user does not know at time of installation what water quality issues may be faced at this location in the future.

BRIEF SUMMARY OF THE INVENTION

In accordance with the present invention a flushing/sampling device is provided that lets the user be prepared to convert the original device (a manual flushing device) into any of: a continuous flushing device, or an automatic flushing device, or a sampling station, or combinations thereof.

In accordance with another aspect of the invention, a novel drain for a hydrant is provided, which can be sealed and opened manually by a user from above ground, without digging.

BRIEF DESCRIPTION OF THE SEVERAL VIEWS OF THE DRAWINGS

FIG. 11 is a view in right-side elevation, partially cut away, of the device of FIGS. 1-9, with the cover removed, showing a continuous discharge flusher installed in the first access tube of the device and discharging into a sewer drain adapter of the device.

FIG. 12 is a view in right-side elevation, partially cut away, of the device of FIGS. 1-9, with the cover removed, showing insertion of a rod into a drain access tube.

FIG. 13 is an enlarged sectional view of the area indicated by line 13-13 of FIG. 12, showing one end of the rod screwed into a threaded passage in the drain access tube to block water flow through it.

FIG. 14 is an enlarged sectional view corresponding to FIG. 13, showing the other end of the rod maintaining flow through the threaded passage.

DESCRIPTION OF THE PREFERRED EMBODIMENT

Figure 6:
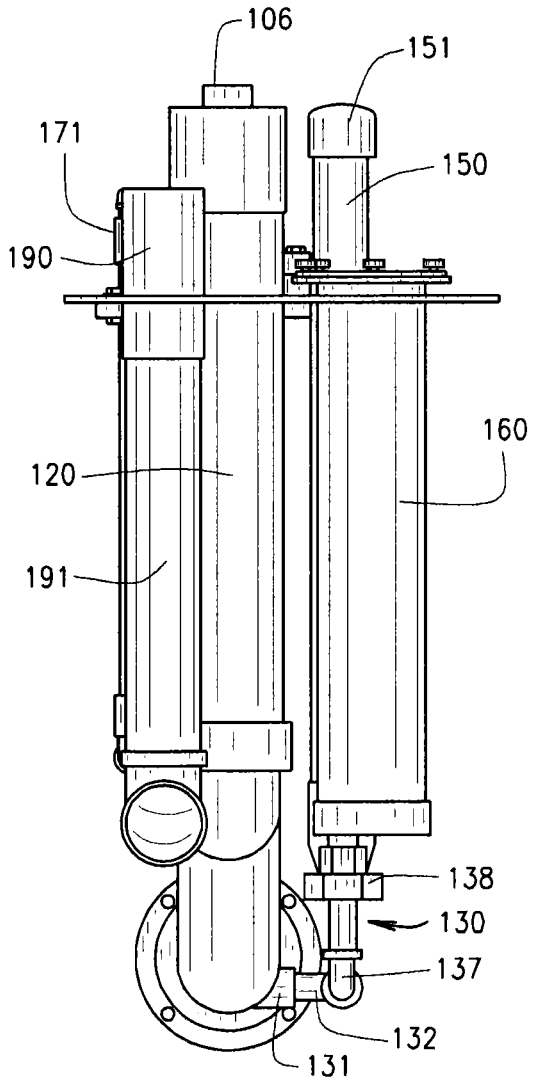
FIG. 6 is a view in left-side elevation of the device of FIGS. 1-5, with the cover removed.
Figure 7:
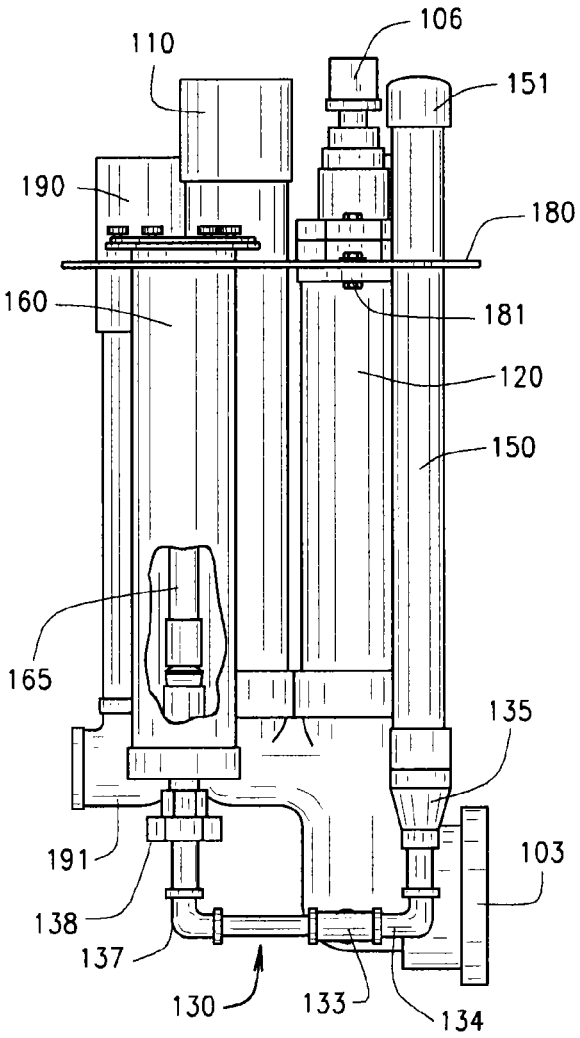
FIG. 7 is a view in rear elevation, partially cut away, of the device of FIGS. 1-6, with the cover removed.
Figure 8:
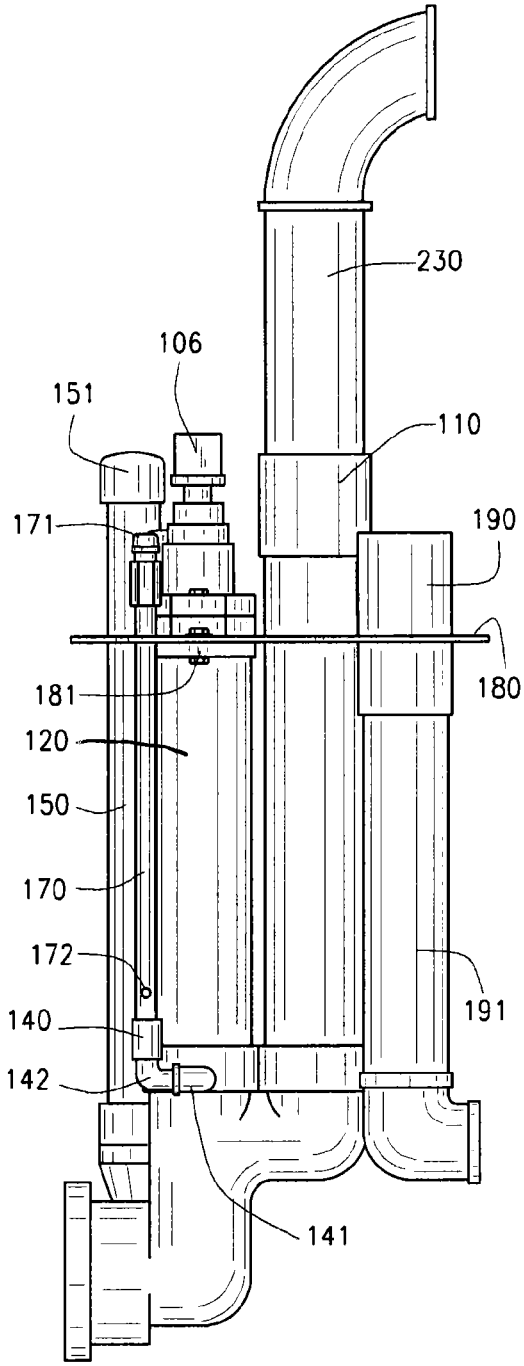
FIG. 8 is a view in front elevation of the device of FIGS. 1-7, with the cover removed and a manual flushing blow-off outlet attached.

The preferred embodiment of a device 1 in accordance with the invention includes a modified Kupferle Mainguard™ manual blow-off hydrant 101. Kupferle hydrants are available commercially from Kupferle Foundry Company, St. Louis, Mo., US. The modified hydrant 101 includes a vertical outlet pipe 110 and a vertical valve stem pipe 120. The vertical outlet pipe 110 may, if desired, be stopped by a cap 111 screwed into its upper end when the outlet pipe is not used. A casting 102 of the hydrant 101 is modified to accept a first adapter 130 (FIGS. 5-7, 9-12 and 15) connected below (upstream of) a valve seat 108 (FIG. 18) and a second adapter 140 (FIGS. 1,3, 5, and 8-12) connected above the valve seat. The first adapter 130 carries a first access tube 150 (FIGS. 3 and 8) and a second access tube 160 (FIGS. 6 and 7); and the second adapter 140 carries a third access tube 170 (FIG. 8), as described hereinafter. A mounting plate 180 (FIGS. 3 and 4), bolted to the valve stem pipe 120 at 181 (FIGS. 7 and 8), has openings for the outlet pipe 110, valve stem pipe 120, access tubes 150, 160, and 170, and a sewer pipe fitting 190.

Figure 1:
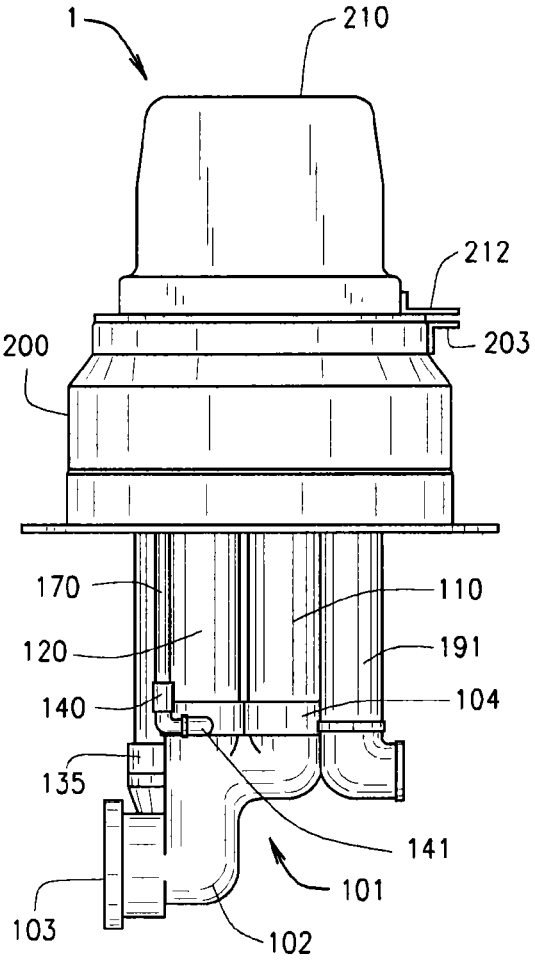
FIG. 1 is a view in front elevation of a reconfigurable water flushing and sampling device of the present invention, with a cover in place.
Figure 2:
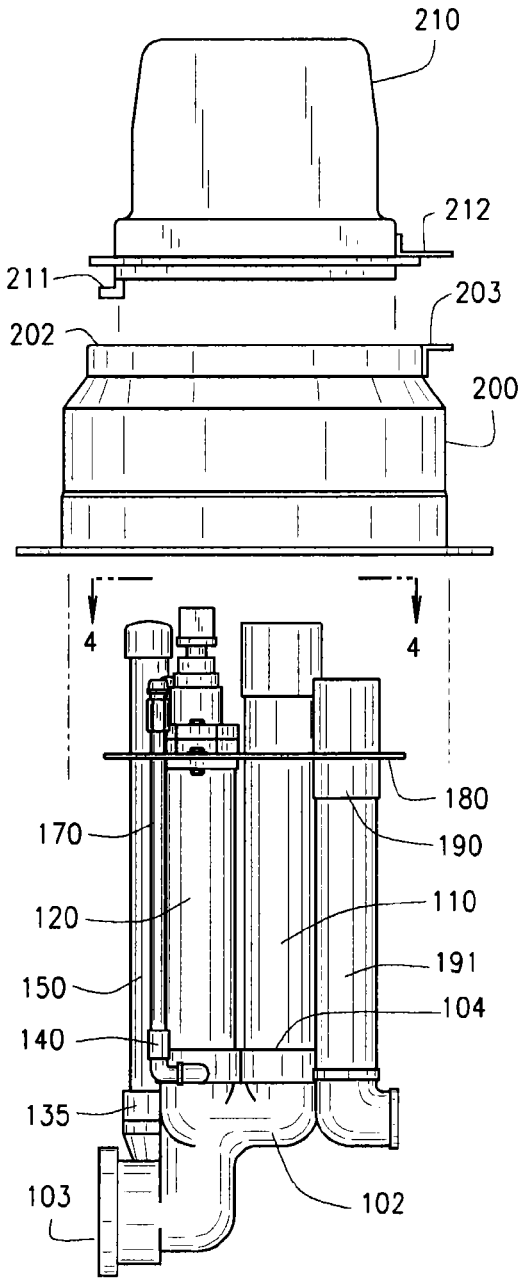
FIG. 2 is a view in front elevation, of the device of FIG. 1, with the cover lifted and disassembled, showing the device in a manual flushing configuration.
Figure 3:
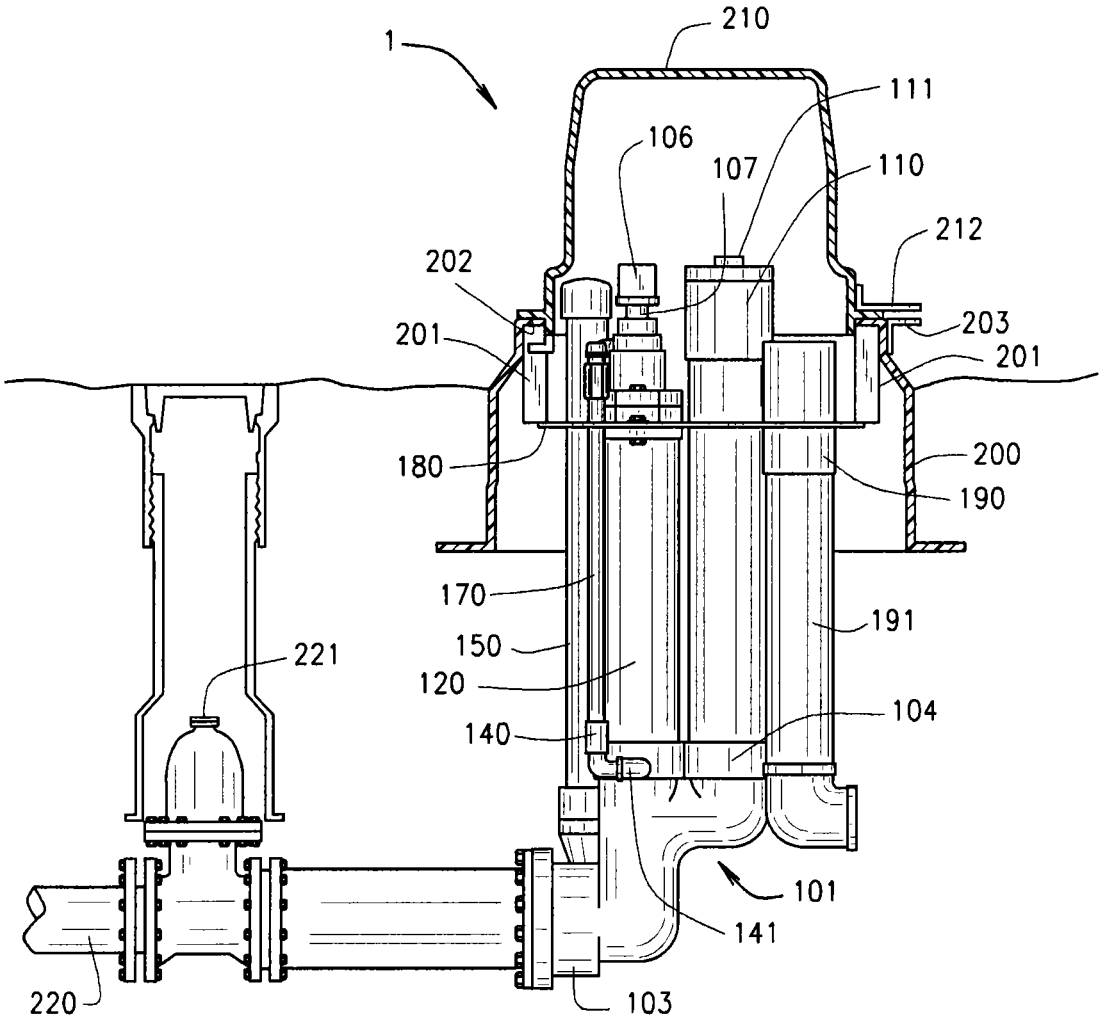
FIG. 3 is a view in front elevation of the device of FIG. 1, with the cover shown in cross-section, attached to a water main through an auxiliary shut-off valve.
Figure 4:
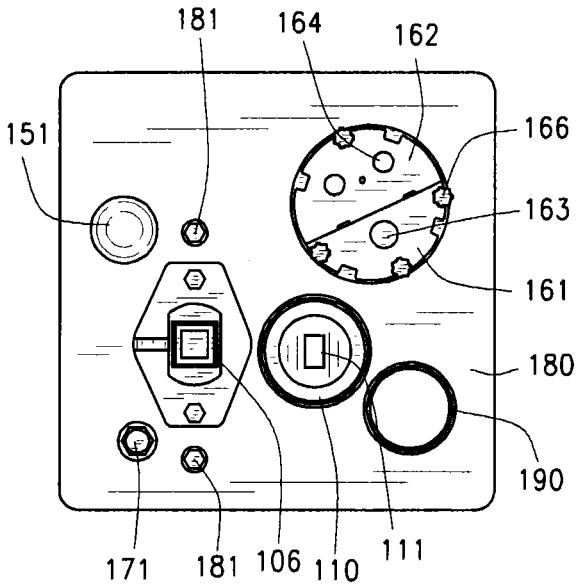
FIG. 4 is a view taken along the line 4-4 of FIG. 2, showing a mounting plate of the device and pipes of the device extending through it.
Figure 5:
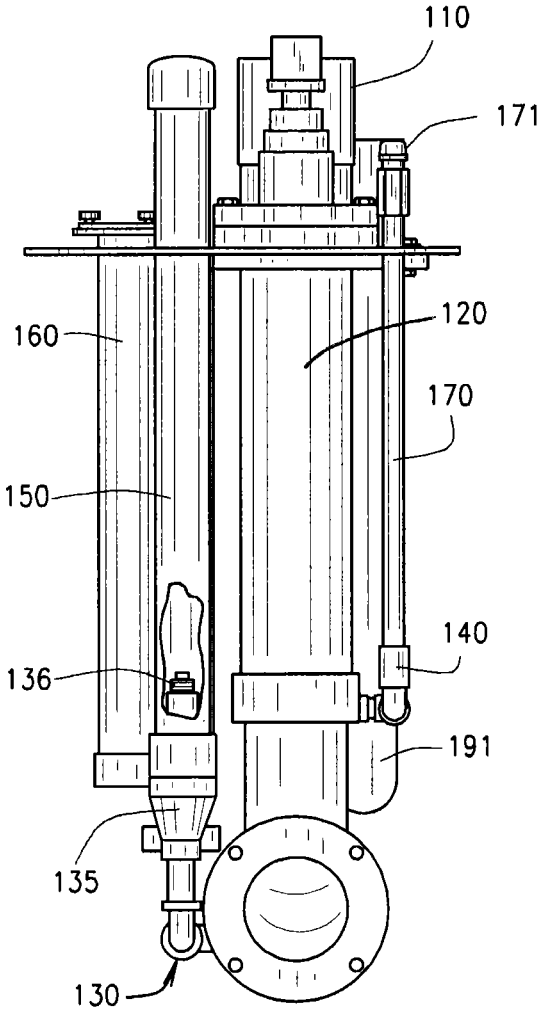
FIG. 5 is a view in right-side elevation, partially cut away, of the device of FIGS. 1-4, with the cover removed.

A molded plastic enclosure 200 rests on the mounting plate 180 and carries a lockable cover 210. The enclosure 200 and cover 210 may be substantially similar to the enclosure and cover of the Kupferle 9800A automatic flushing device. Internal fins 201 (FIG. 3) of a molded plastic enclosure 200 are seated on the mounting plate 180 and align the enclosure with the mounting plate 180. The mounting plate is typically at or slightly below ground level, as seen in FIG. 3. The lower part of the enclosure 200 is buried, and the upper, inturned margin 202 of the enclosure 200 is somewhat above ground. An out-turned ear 211 (FIGS. 1-2) on a side of the cover 210 engages the inturned margin 202 of the enclosure, and an outwardly extending bracket 212 on the opposite side of the cover 210 aligns with an outwardly extending bracket 203 of the enclosure 200, to allow locking of the cover 210 as by a padlock or the like extending through aligned holes in the brackets 212 and 203. The cover 210 is tall enough to accommodate certain elective components such as an automatic flusher or a continuous flusher, which are intended to be used over a long period of time, and not merely while workers are servicing the device.

Figure 18:
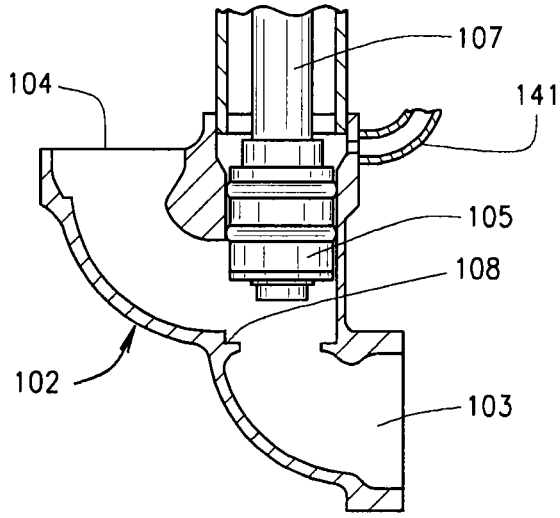
FIG. 18 is a cross-sectional view of a casting of the device with a plunger rod positioned in the casting.

The hydrant 101 casting 102 has an inlet 103, an outlet 104, and a manually operated valve plunger 105 (FIG. 18), which is manipulated by an operating nut 106 (FIG. 3) through a rod 107 to raise and lower the valve plunger 105 into and out of sealing engagement with a seat 108. (FIG. 18)

The casting 102 of the present invention is modified from the standard hydrant in having a first female outlet boss 131 (FIG. 6) formed in the inlet upstream of the seat 108. A first adapter 130 (FIGS. 5-7) is threaded into the outlet boss 131. The adapter 130 includes a stub pipe 132 threaded into the outlet boss 131, in fluid communication with the inlet 103, a T-pipe 133 threaded into the stub pipe 132 (with the stem of the T threaded to the stub pipe, a first elbow 134 connected to one side of the cross-tube of the T, and a first transition 135 having an upwardly facing peripheral flange at its upper end sized to receive the first access tube 150. The first access tube 150 has a removable cap 151. The transition 135 also includes a central connection 136 (FIGS. 5 and 9-11) for various devices that may be threaded onto it. The central connection 136 is illustratively an upwardly-facing male portion of a screw-together fitting. The male portion contains a closure which is opened when a female fitting is threaded onto it.

The first adapter 130 also includes a second elbow 137 (FIGS. 6 and 7) threaded into the other side of the T-pipe 133, and a second transition 138. The second transition 138 supports the perforated bottom 167 (FIG. 16) of the second access tube 160 and provides an upwardly facing female portion 139 (FIG. 15) of a push-together fitting. To prevent water from discharging through the fitting 139, a stopper 165 is pushed into the fitting 139. The stopper 165 is formed of a section of rigid plastic tubing having a plug 166 at its lower end and held at its upper end by a first semi-circular removable hold-down plate 161, having a cut-out or recess 163 (FIG. 16) sized to engage the upper end of the stopper 165. The hold-down plate 161 is held to the mounting plate 180 by bolts 166. A second semi-circular removable plate 162 is releasably hinged to the first hold-down plate 161 as described hereinafter.

In many known hydrants, a drain hole is located in the casting above the plunger and drains the outlet to well below frost level when the valve 105 is closed, but is isolated from the flow passage when the valve 105 is open. The Kupferle Mainguard™ hydrant has a particularly elegant arrangement in which o-rings on the plunger 105 isolate the drain hole without ever contacting the drain hole, but the particular arrangement is not critical to the present invention. In accordance with the present invention, the drain hole of the Kupferle Mainguard™ hydrant is replaced by a threaded elbow 141 (FIGS. 8 and 18) into which is threaded the second adapter 140. The second adapter 140 includes an elbow 142 into which is threaded the third access tube or pipe 170; the third access tube having a cap 171 threaded onto its upper end. Near the lower end of the third access tube 170 is a drain hole 172. At the lower end of the access tube 170 is a threaded passage 173 (FIGS. 13 and 14) communicating with the interior of valve stem pipe 120 through the elbow 141. Thus, when the threaded passage 173 is open, the drain hole 172 functions as an ordinary drain hole. If, however, it is desired to isolate the interior of the hydrant from the gravel or other material surrounding the drain hole 172, the threaded passage 173 may be closed. This might be desired if, for example flooding occurs, thereby increasing the chances of backflow from the drain hole into the potable water supply. Blocking the threaded passage is easily accomplished with a rod 174 (FIG. 12) extending to the top of the access tube 170. One end 174*a* of the rod is formed with a non-circular shape to make it easy to grip, and the other end 174*b* is formed with a male threaded stud having an o-ring at a shoulder at the top of the stud. A user needs merely to remove the cap 171 from the access tube 170, hold the rod at its non-circular end 174*a*, and screw the threaded end 174*b* of the rod 174 into the passage 173 in order to isolate the drain hole from the potable water in the hydrant. When it is desired to open the drain hole, to render the hydrant freeze-proof, the user removes the cap 171, unscrews the rod 174, turns it over, and drops it back into the access tube 170, where the non-circular end 174*a* ensures that water can flow through the passage 173 and out the drain hole 172. The entire operation can be carried out from above, without digging or reaching down to the level of the hole. This feature is believed to be useable with all hydrants.

The device 1 permits numerous types of flushing, depending on the user's needs at any time. Because the basic unit consists mainly of pipes and a casting, the additional cost to the user is not great in comparison with the cost of digging and installing a flushing hydrant of any sort. Typically the device, as any hydrant, is connected to a water main 220 through an auxiliary shout-off valve 221, as shown in FIG. 3, by digging a pit, filling it with gravel to the desired depth, and bolting the inlet 103 of the device 1 to a flange of the water main. A sewer line 191 is run from the fitting 190, to a sewer or appropriate discharge point, adding a P-trap if desired. Gravel is then added around the device 1, and the pit is filled with dirt to ground line.

Standard Configuration:

In its simplest configuration, no hardware beyond that already described is installed in the device 1. When a user wishes to flush that portion of the water system, he or she opens the cover 210 of the device 1, and removes the cap 111 from the outlet pipe 110. Although not strictly required, an outlet pipe 230 (FIG. 8) can be threaded into the outlet pipe 110, and the operating nut 106 is turned to move the operating rod 107 and plunger 105 upward. This allows water to flow through hydrant waterway 110 and out hydrant discharge pipe 230. When the hydrant is closed, o-rings on the plunger 105 move down and allow water to drain from hydrant 1 through drain hole 172.

Figure 9:
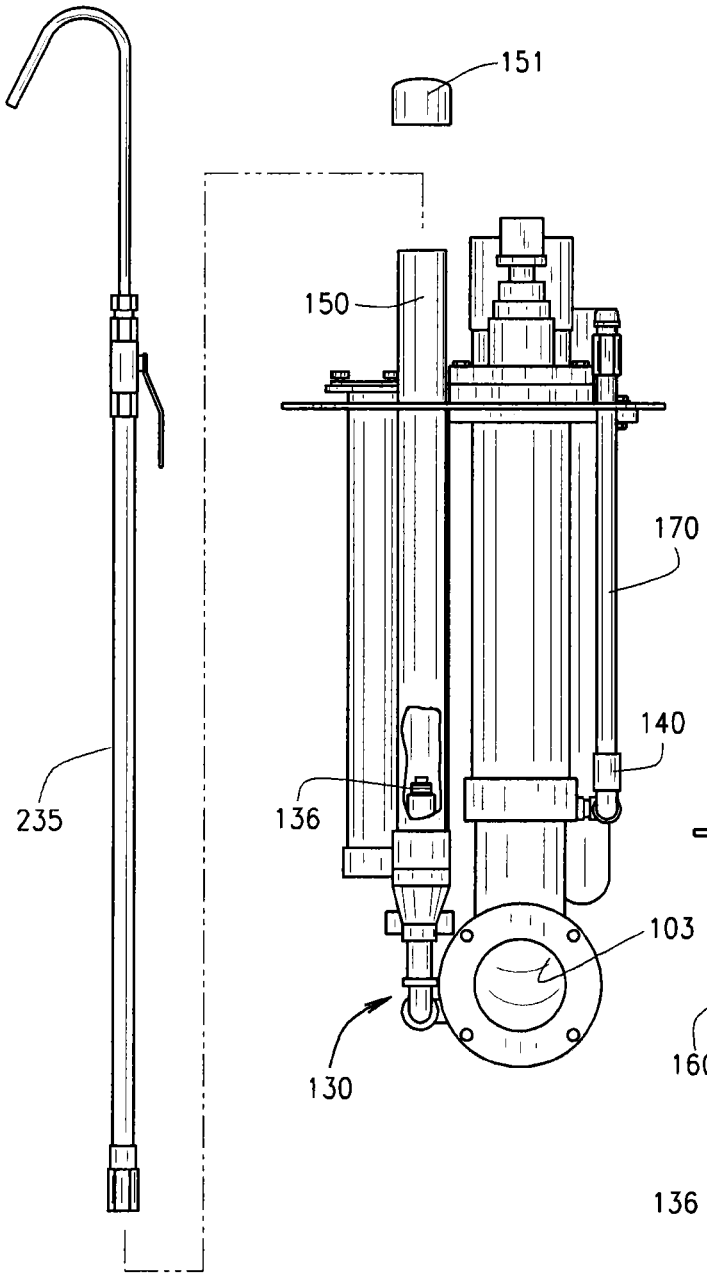
FIG. 9 is a view in right-side elevation, partially cut away, of the device of FIGS. 1-8, with the cover removed, showing insertion of a sampling tube into a first access tube of the device.
Figure 10:
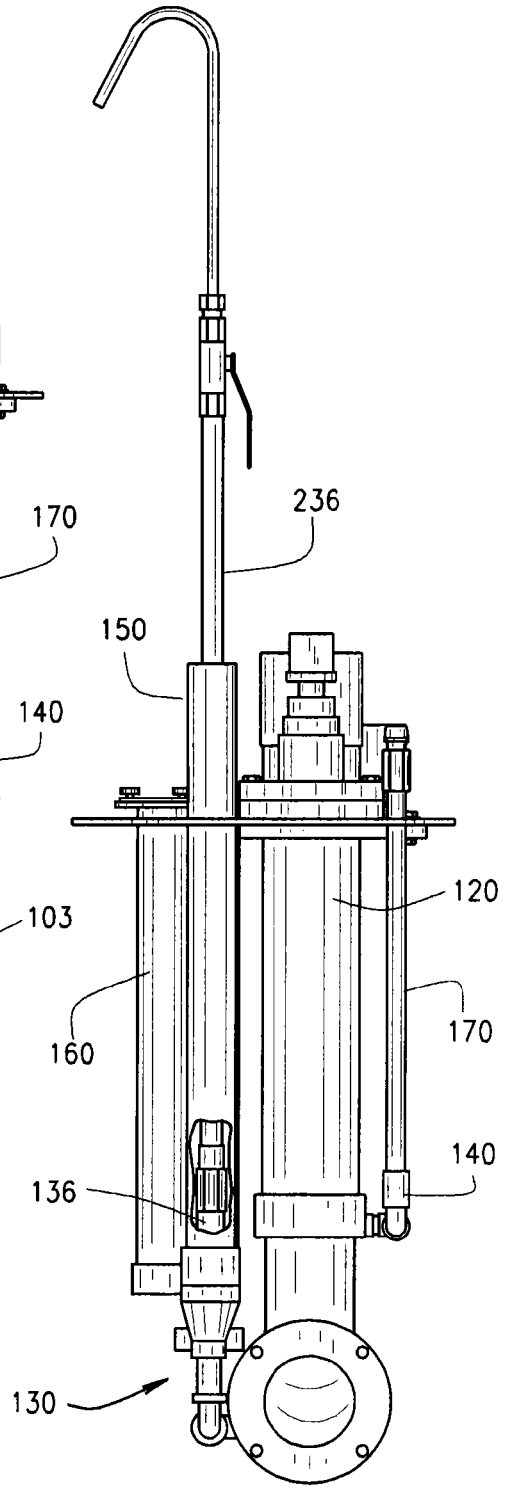
FIG. 10 is a view in right-side elevation, partially cut away, of the device of FIGS. 1-9, with the cover removed, showing the sampling tube installed in the first access tube of the device.

As desired or needed, the following options may be added to the device of FIGS. 1-7:

Sampling:

Rod 174 can be turned over and screwed into threaded passage 173 to plug the drain. Then water sampling can be performed without cross-contamination risk. As shown in FIGS. 9 and 10, sampling is performed by removing cap 151 from the first access tube 150, sliding a sampling rod 235 down first access tube 150, and threading the sampling rod 235 onto connector 136. The sampling rod is preferably a Kupferle Model 92. After sampling, the sampling rod 235 and its water will be removed to prevent freezing, and the cap 151 replaced.

Continuous Flushing:

As shown in FIG. 11, if continuous flushing is desired, a flushing pipe 240 is threaded onto connector 136. Water will flow up through flushing pipe 240 and discharge, with air-gap in between, down into sewer pipe fitting 190 and sewer line 191. The flushing pipe 240 is preferably a modification of the sampling rod 235 with a longer discharge tube. It may also be a modification of the Kupferle Model 5100 with a male threaded connector at its inlet end and a suitably dimensioned outlet tube.

Figure 15:
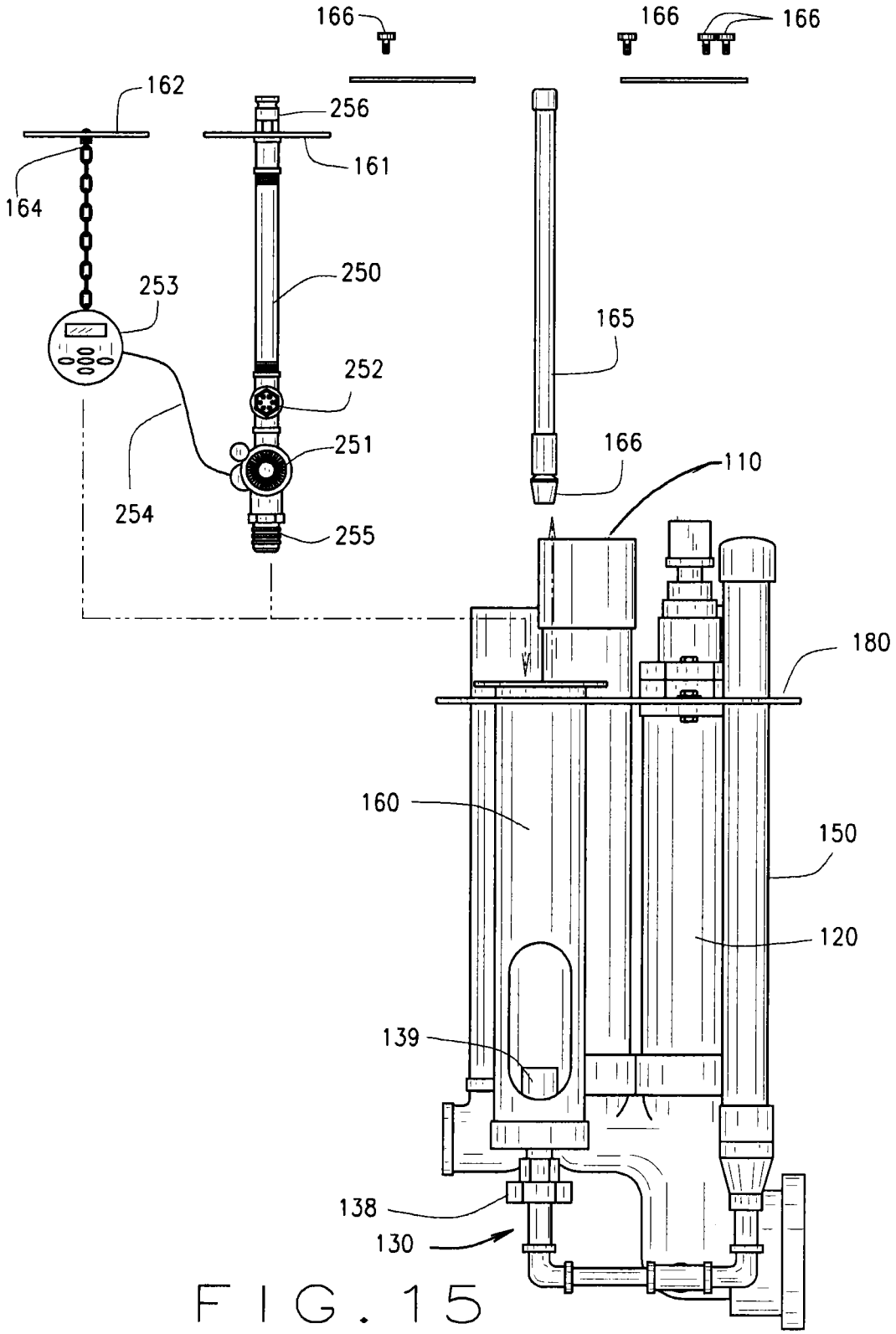
FIG. 15 is a view in rear elevation of the device, partially cut away, showing removal of a stopper and insertion of an automatic flushing device into a second access tube of the device.
Figure 16:
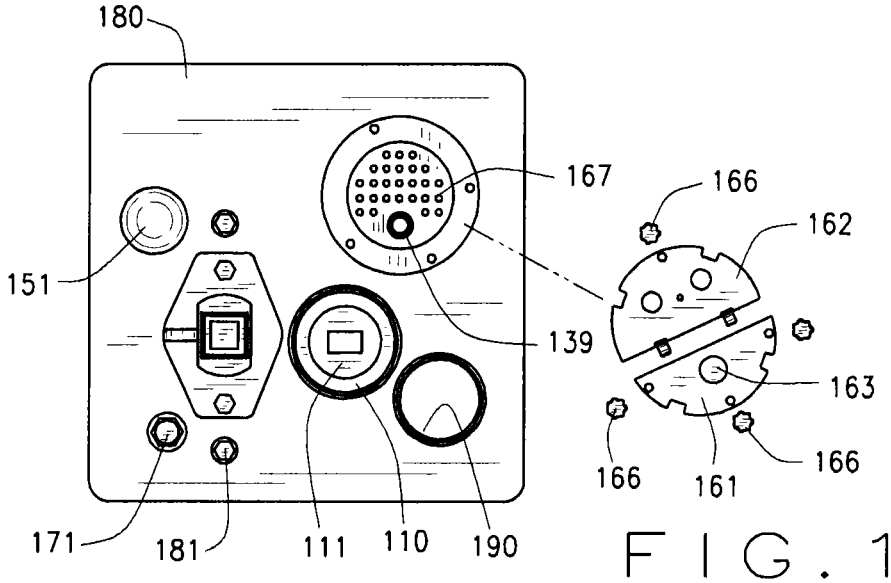
FIG. 16 is a top plan view of the device, corresponding generally to FIG. 4, showing a cover plate removed from the second access tube.
Figure 17:
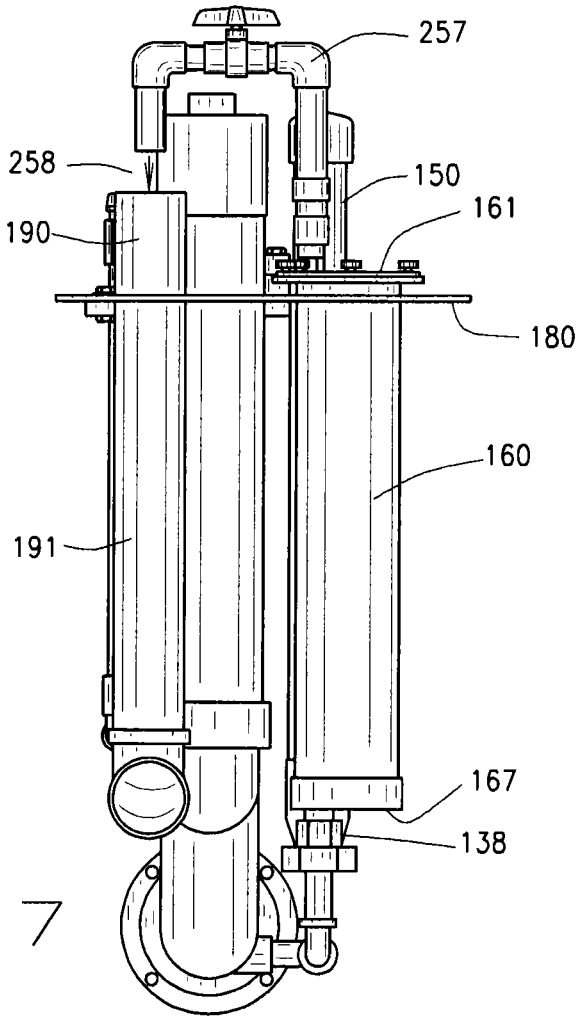
FIG. 17 is a view in left-side elevation of the device with the automatic flushing device installed in the second access tube of the device.

Automatic Flushing:

As shown in FIGS. 15-17, removal of hold down plates 161 and 162 and stopper 165 allows insertion of an automatic flushing assembly 250 including an automatic valve 251, an automatic drain 252, and discharge piping 257. The lower end 255 of the assembly 250 is a push-together o-ring connection which is inserted into the female pipe end 139. The upper end of the assembly 250 terminates in a quick-disconnect male part 256. The upper end of the assembly 250 and the quick-disconnect 256 trap between them a semi-circular removable hold-down plate 161. When the hold-down plate 161 is bolted to the mounting plate 180, the assembly 250 is held against upward movement by the plate 161, in a manner similar to that of the first embodiment of McKeague, U.S. Published Application 2007/0075162 A1 which is incorporated herein by reference. Valve controller 253 is programmed and then suspended from hangers 164 in plate 162. The valve controller is electrically connected to the valve 251 by an appropriate electrical connection 254. The plate 162 is then hooked into plate 161 and bolted down. A discharge piping assembly 257 (FIG. 17) is then clamped onto the quick disconnect 256, and arranged to discharge into the sewer pipe fitting 190 and sewer 191. The automatic valve 251 opens periodically under the control of the controller 253. An air gap 258 prevents backflow of water. When the valve 251 closes, automatic drain 252 drains water from the piping assembly 257 and the upper parts of assembly 250, and the water drains out of the device through perforated wall 167.

The automatic valve 251 could be operated remotely by a variety of methods, include SCADA (Supervisory Control and Data Acquisition) systems, radio devices, or any other system which would allow for remote control of the valve 251. In this variation, the controller 253 would be signaled from a remote location to initiate a flushing cycle.

Figure 19:
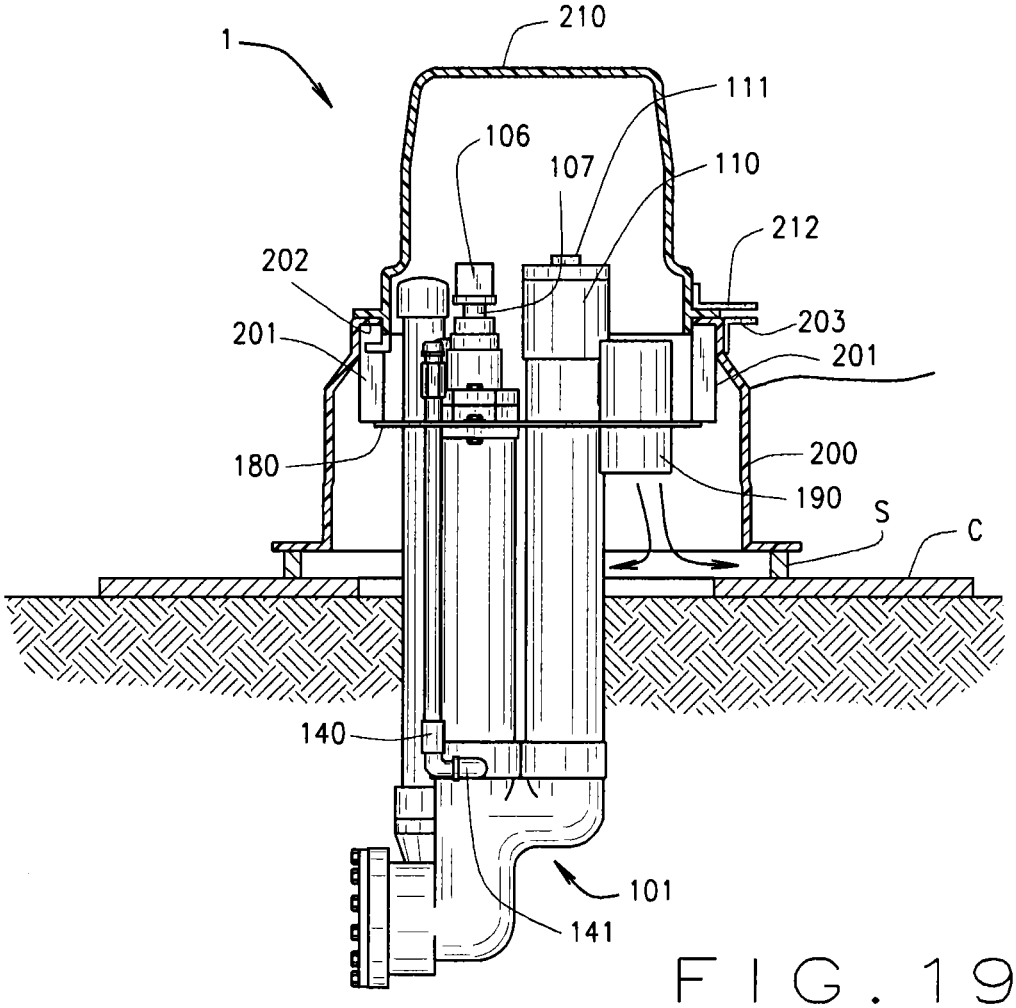
FIG. 19 is a view similar to FIG. 3, but wherein the device is mounted on a concrete slab in an installation where a sewer pipe is not available.

An alternate embodiment 1' of the device is shown in FIG. 19. The device 1' is substantially similar to the device 1, but is modified to be used in installations where there is no sewer line available. In this embodiment, the device is mounted to concrete pad C with spacers S to provide a gap between the bottom of the enclosure 200 and the concrete pad C. The device 1' does not include the tube 191, and when water is flushed, the water flows through the tube 190 to be discharged horizontally to ground, as shown by the arrows in FIG. 19.

All patents, applications, and other documents mentioned herein are hereby incorporated by reference.

Numerous variations in the reconfigurable water flushing and sampling device of the present invention will occur to those skilled in the art in view of the foregoing disclosure. Merely by way of example, the drain hole female outlet boss 131 could be directly attached to sewer pipe 191. The first and second adapters 130 and 40 could be arranged in series rather than on either side of the first boss 131. These variations are merely illustrative. The disclosure of preferred embodiments is therefore not by way of limitation, but by way of illustration.

The invention claimed is:

1. A reconfigurable water flushing and sampling device comprising a casing defining an enclosure, an inlet extending into the enclosure, the inlet including structure constructed for connecting the device to a water distribution system, a first valve which opens and closes the inlet, an outlet within the casing, a first vertical pipe in the casing, the first vertical pipe being attached to the inlet upstream of the valve, the first vertical pipe including structure constructed for connecting a second valve, and a second vertical pipe in the casing, the second vertical pipe being attached to the inlet upstream of the first valve, the second vertical pipe including structure for connecting a sampling rod.

2. The device of claim 1 including a continuous flushing pipe attachable to the second vertical pipe.

3. A hydrant having an inlet, an outlet, a valve between the inlet and the outlet, an opening permitting drainage of a portion of the hydrant above the valve when the valve is closed, an adapter attached to the hydrant in fluid communication with the opening, the adapter having a secondary opening and a closure between the hydrant opening and the secondary opening, the closure being selectively closeable to prevent drainage of the portion of the hydrant, the adapter including an elongate conduit communicating with the closure, and a rod in the conduit, one end of the rod being configured to close the closure and the other end of the rod being configured to keep the closure open, the closure comprising a threaded seat and wherein one end of the rod is configured not to block the seat when brought into the vicinity of the seat, and the other end of the rod is threaded and configured to be threaded into the threaded seat.

* * * * *